US006073321A

United States Patent [19]

Kitahara et al.

[11] Patent Number: 6,073,321

[45] Date of Patent: Jun. 13, 2000

[54] MANUFACTURING METHOD FOR AN INK JET RECORDING HEAD

[75] Inventors: Kohei Kitahara; Tomoaki Abe, both of Nagano, Japan

[73] Assignee: Seiko Epson Corporation, Tokyo, Japan

[21] Appl. No.: 08/877,184

[22] Filed: Jun. 17, 1997

Related U.S. Application Data

[62] Division of application No. 08/427,831, Apr. 26, 1995, Pat. No. 5,929,881.

[30] Foreign Application Priority Data

Apr. 26, 1994 [JP] Japan ..... 6-112191
Jun. 20, 1994 [JP] Japan ..... 6-160521

[51] Int. Cl.[7] ..... H04R 17/00

[52] U.S. Cl. ..... 29/25.35; 29/890.1

[58] Field of Search ..... 29/25.35, 890.1

[56] References Cited

U.S. PATENT DOCUMENTS

| | | | |
|---|---|---|---|
| 3,769,629 | 10/1973 | Sambucetti | 346/74 |
| 4,825,227 | 4/1989 | Fischbeck et al. | 346/1.1 |
| 5,121,024 | 6/1992 | Seto | 29/25.35 |
| 5,266,964 | 11/1993 | Takahashi et al. | 29/25.35 |
| 5,281,888 | 1/1994 | Takeuchi et al. | 310/366 |
| 5,475,279 | 12/1995 | Takeuchi et al. | 310/331 |
| 5,774,961 | 6/1998 | Takeuchi et al. | 29/25.35 |
| 5,802,686 | 9/1998 | Shimada et al. | 29/890.1 |

FOREIGN PATENT DOCUMENTS

| | | | |
|---|---|---|---|
| 554912 | 8/1993 | European Pat. Off. | 29/890.1 |
| 0584823 | 3/1994 | European Pat. Off. . | |
| 584823 | 3/1994 | European Pat. Off. | 29/25.35 |
| 0723867A2 | 7/1996 | European Pat. Off. . | |
| 3272855 | 3/1990 | Japan | 29/25.35 |
| 3133184 | 6/1991 | Japan | 29/25.35 |
| 03 272855 | 3/1992 | Japan . | |
| 04 169237 | 9/1992 | Japan . | |
| 05 024188 | 6/1993 | Japan . | |
| 5318735 | 12/1993 | Japan | 29/890.1 |

OTHER PUBLICATIONS

German Patent Office—Office Action of Jan. 8, 1997 with translation.

*Primary Examiner*—Lee Young
*Assistant Examiner*—A. Dexter Tugbang
*Attorney, Agent, or Firm*—Sughrue, Mion, Zinn Macpeak & Seas, PLLC

[57] ABSTRACT

A method of manufacturing an inkjet recording head including drive electrodes arrayed at fixed pitches on the surface of an elastic plate, a common lead-out electrode lead from a common electrode formed on the surface of the elastic plate, the common lead-out electrode being arrayed extending in the direction of the arrays of the drive electrodes, while being spaced a fixed distance from the drive electrodes, the ends of the common lead-out electrode being connected to external, and piezoelectric vibration plates of which the reverse sides are in contact with the drive electrodes, and to the first ends are continuous, covering the common lead-out electrode. No disconnection is formed in the area of the piezoelectric vibration plates where the two groups of the piezoelectric vibration plates face, thereby ensuring a reliable bonding of the piezoelectric vibration plates and the elastic plate.

7 Claims, 8 Drawing Sheets

MANUFACTURING METHOD FOR AN INK JET RECORDING HEAD

This is a divisional of application Ser. No. 08/427,831 filed Apr. 26, 1995, now U.S. Pat. No. 5,929,881.

BACKGROUND OF THE INVENTION

1. Field of the Invention

The present invention relates to an ink jet recording head in which a piezoelectric vibration plate is stuck to a part of a pressure generating chamber communicating with nozzle openings, and a deflection vibration of the piezoelectric vibrating plate compresses the pressure generating chamber to generate ink droplets.

2. Related Art

In the known ink jet recording head, a piezoelectric vibration plate is stuck onto an elastic plate as a part of the pressure generating chamber in a stretched fashion. By a deflection vibration of the piezoelectric vibration plate, the volume of the pressure generating chamber is varied to cause ink droplets. In this ink jet recording head, the pressure chamber can be compressed and expanded over a broad area thereof, so that ink droplets can be forcibly discharged from the nozzle openings thereof.

In the construction of the piezoelectric vibration plate assembled into the ink jet recording head small thin layers made of piezoelectric material are arrayed on an elastic plate. Electrodes are layered on both sides of the resultant structure. In operation, a drive signal is applied to the electrodes, to thereby deflect the resultant piezoelectric vibration plate in a vibration mode.

To efficiently transfer a deflection vibration of the piezoelectric vibration plate to the elastic plate, it is necessary to reliably bond the reverse side of the piezoelectric vibration plate onto the elastic plate.

A novel technique to improve the bonding of the piezoelectric vibration plate to a substrate is disclosed in Japanese Patent Laid-Open Publication No. Hei. 5-267742. A drive electrode made of conductive material having a satisfactory bonding force is formed on the drive electrode area of the elastic plate onto which the piezoelectric vibration plate is attached, during a process of sintering a piezoelectric material. A lead-out electrode led from a common electrode, which is made of the same material as of the drive electrode, is formed also in the area, which does not directly contribute to the piezoelectric vibration. For the piezoelectric vibration plate, the tips of the piezoelectric vibration plates partially overlap on the lead-out electrode led from the common electrode, thereby increasing the bonding force of the piezoelectric vibration plates and the substrate.

This technique considerably increases the bonding force of the plate member and the piezoelectric vibration plates. However, where the piezoelectric vibration plates are reduced in size, a problem arises, viz., the contact areas of the piezoelectric vibration plates and the lead-out electrode for the common electrode are not uniform in size. As a result, the tip A of the piezoelectric vibration plate is raised from the lead-out electrode B for the common electrode, as shown in FIG. 10. The bonding force of the piezoelectric vibration plates and the substrate ia weakened. A connection point D of the common electrode C formed on the upper surface and the lead-out electrode B is thinned in thickness.

SUMMARY OF THE INVENTION

A first object of the present invention is to provide an ink jet recording head in which the piezoelectric vibration plates are firmly bonded onto the substrate by making use of the array structure of the piezoelectric vibration plates.

A second object of the present invention is to provide an ink jet recording head which is free from a disconnection of the common electrode formed on the surface of the piezoelectric vibration plates.

A third object of the present invention is to provide a method of manufacturing ink jet recording heads.

According to the present invention, drive electrodes and a lead-out electrode led from a common electrode are formed for piezoelectric vibration plates. The lead-out electrode is located between two groups of pressure generating chambers oppositely arrayed on the surface of the elastic plate. The piezoelectric vibration plates extend from the locations near to the second ends of a first group of the drive electrodes to the locations near to the second ends of a second group of the drive electrodes.

The piezoelectric vibration plates are continuous connecting two groups of pressure generating chambers. Accordingly, the end parts thereof that may be raised are absent in the central part.

BRIEF DESCRIPTION OF THE DRAWINGS

FIG. 6(*b*) is a cross sectional view taken on line I—I of FIG. 6(*a*);

FIG. 6(*c*) is a cross sectional view taken on line II—II of FIG. 6(*a*);

FIG. 8(*b*) is a cross sectional view taken on line III—III of FIG. 8(*a*); and FIG. 8(*c*) is a cross sectional view taken on line IV—IV of FIG. 8(*a*).

DETAILED DESCRIPTION OF THE PREFERRED EMBODIMENTS

Figure 1:
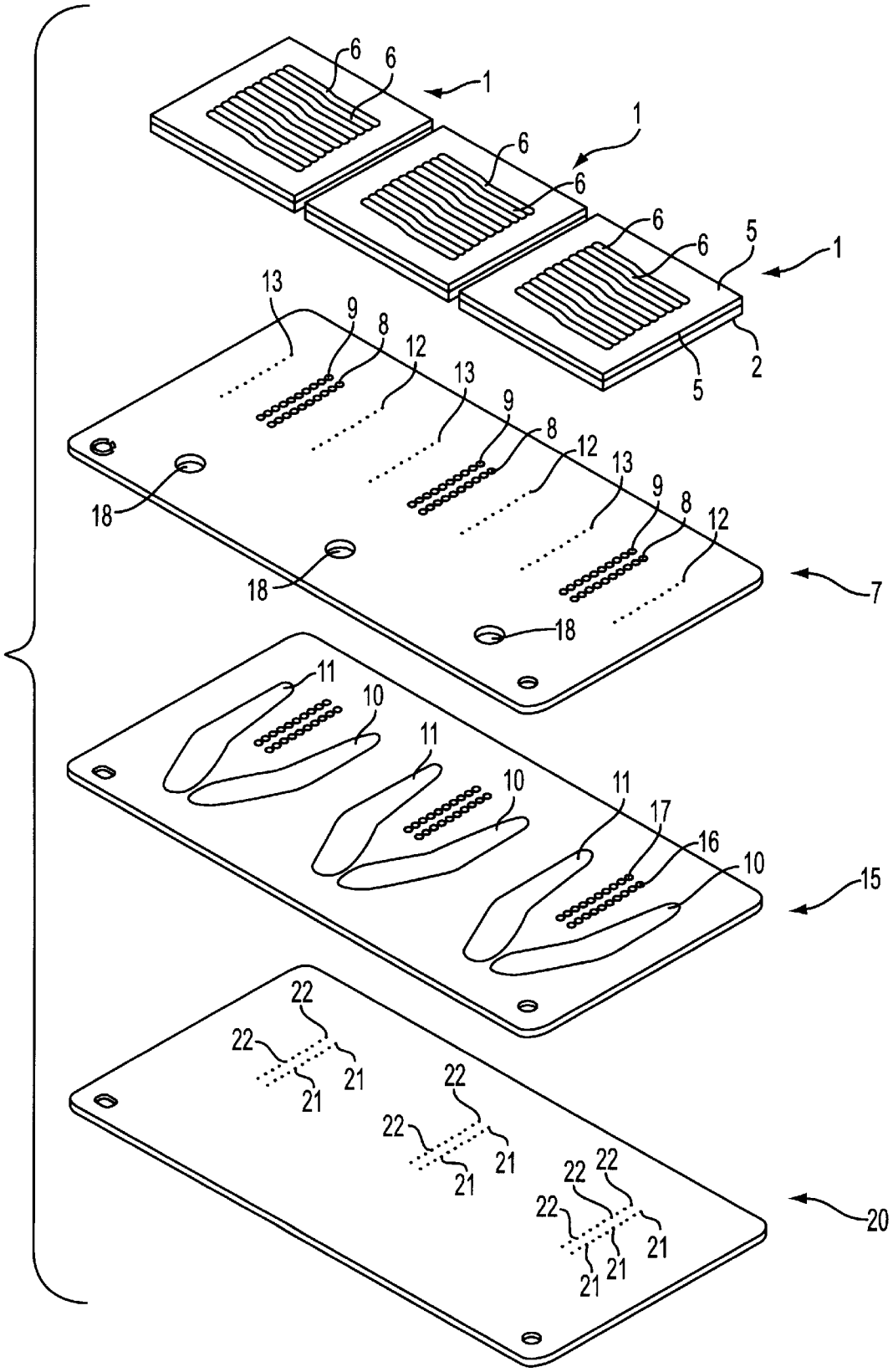
FIG. 1 is an exploded, perspective view showing an embodiment of an ink jet recording head according to the present invention.
Figure 2:
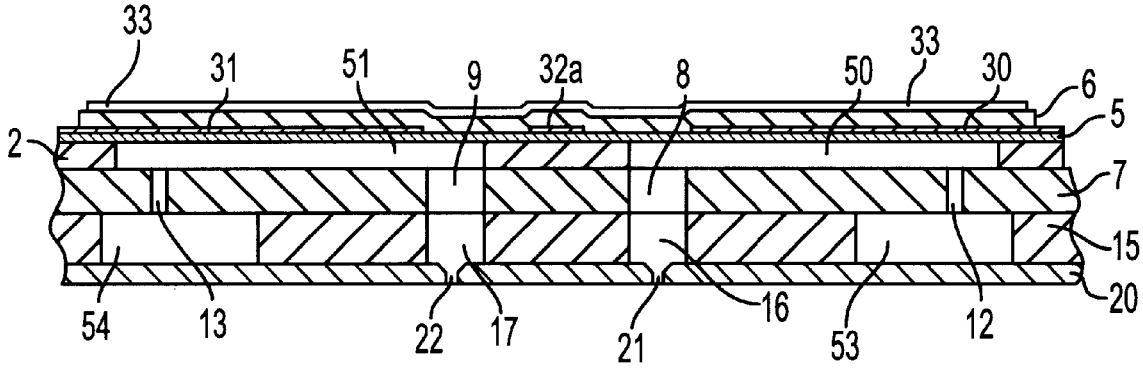
FIG. 2 is a cross sectional view showing the embodiment of the present invention.
Figure 3:
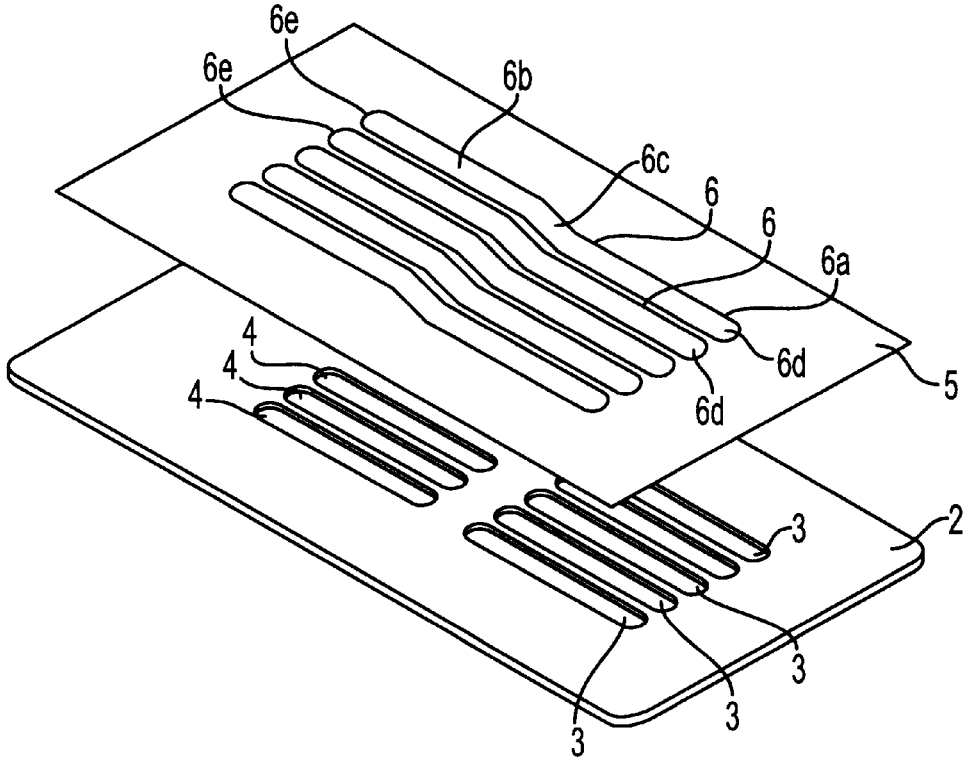
FIG. 3 is an exploded, perspective view showing an example of the drive unit.

FIG. 1 is an exploded, perspective view showing an embodiment of the present invention. FIG. 2 is a cross sectional view showing the embodiment of FIG. 1. In these figures, 1, 1, and 1 designate first members formed in one step by a process of sintering. As shown in FIG. 3, each of the first members is formed of a spacer member 2 and an elastic plate 5. In the construction of the spacer member 2, a substrate consists of a ceramics plate made of zirconia ($ZrO_2$). The substrate has the thickness suitable for formation of first and second groups 50 and 51 of pressure generating chambers of 150 μm deep. Through-holes 3, 3, 3, . . . and 4, 4, 4, . . . , which are to be the pressure generating chamber groups 50 and 51, are formed in the substrate. These through-holes formed are arrayed in a zig-zag fashion, as shown.

The elastic plate 5 exhibits a sufficient bonding force when it is sintered, together with the spacer member 2. The elastic plate consists of a thin plate of 10 μm thick, which is made of such a material as to be elastically deformable by a strain displacement of piezoelectric vibration plates 6 to be given later. The material is the same zirconia as of the spacer member in this embodiment.

The piezoelectric vibration plates 6 are formed on the surface of the elastic plate by sintering process. The piezoelectric vibration plates 6 are disposed such that the first half parts 6*a* thereof confront with the through-holes for the first pressure generating chamber group 50, while the second half parts 6*b* thereof confront with the through-holes for the second pressure generating chamber group 51. The central parts 6*c* of these piezoelectric vibration plates are slightly bent so as to cross an lead-out electrode 32*a* led from a common electrode to be described later.

Referring again to FIGS. 1 and 2, reference numeral 7 designates a cover plate fastened to the second side of the spacer member 2. The spacer member 2 is a thin plate of 150 μm thick, made of zirconia. Through-holes 8 and 9 and through-holes 12 and 13 are formed in the spacer member 2. The through-holes 8 and 9 connect nozzle openings 21 and 22 to the first and second pressure generating chamber groups 50 and 51. The through-holes 12 and 13 connect through-holes 10 and 11 to define reservoirs 53 and 54 to be given later to the first and second pressure generating chamber groups 50 and 51.

Reference numeral 15 designates a plate for providing an ink supply path. The plate, which is suitable for formation of ink supply paths, is made of material of corrosion proof, e.g., a stainless steel, and 150 μm thick. The through-holes 10 and 11 and through-holes 16 and 17 are formed in the ink-supply-path plate 15. The through-holes 10 and 11, which define the reservoirs 53 and 54, are arrayed in a V-shape. The through-holes 16 and 17 connect the first and second pressure generating chamber groups 50 and 51 to the nozzle openings 21 and 22. The through-holes 10 and 11 to be the reservoirs 53 and 54 communicate with ink supply ports 18 formed in the cover plate 7. From the through-holes, the ink of which the amount corresponds to that of ink consumed by the printing operation, is supplied to the first and second pressure generating chamber groups 50 and 51, through the through-holes 12 and 13.

A nozzle plate 20, suitable for formation of the nozzle openings 21 and 22 of 40 μm in diameter, is a stainless steel plate of 60 μm thick. The nozzle openings 21 and 22 communicate with the first and second pressure generating chamber groups 50 and 51, through the through-holes 8 and 9 of the cover plate 7 and the through-holes 16 and 17 of the ink-supply-path plate 15, which are disposed aligned with the nozzle openings.

Those members 1, 7, 15, and 20 are layered into a single structure of an ink jet recording head, by a bonding means suitable for the materials thereof, such as adhesive or sintering.

Figure 4:
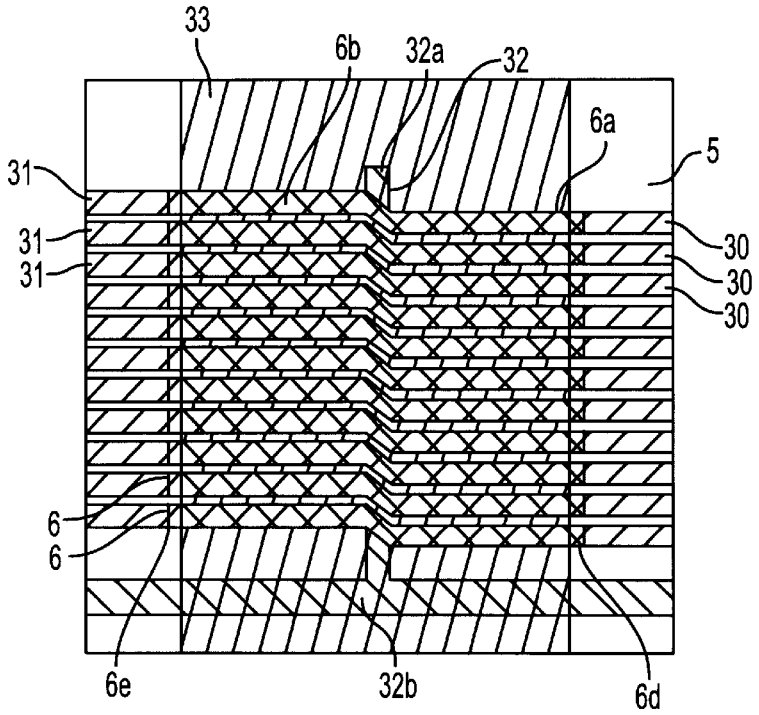
FIG. 4 is a top view showing an embodiment of the drive unit.

FIGS. 3 and 4 show the surface structure of the piezoelectric vibration plates 6 that are formed on the surface of the elastic plate 5. In the figures, reference numeral 30 designates second drive electrodes, which are formed on the surface of the elastic plate 5 in association with the first pressure generating chamber group 50. Reference numeral 31 designates first drive electrodes associated with the other group of the second pressure generating chamber group 51. The first ends of the drive electrodes 30 are spaced predetermined distance from the lead-out electrode 32*a* located at the central part of the structure, while the second ends thereof are terminated at the end of the elastic plate 5.

Reference numeral 32 designates the lead-out electrode led from the common electrode. The lead-out electrode is located at the mid position between the two groups of the nozzle openings 21 and 22. The lead-out electrode 32 consists of the first area 32*a* extending in the direction of the arrays of the first and second drive electrodes 30 and 31, viz., in the vertical direction as viewed in the drawing, and the second area 32*b* extending in the direction orthogonal to the first area, viz., in the horizontal direction.

Of those electrodes, the first and second drive electrodes 30 and 31, which are in contact with the piezoelectric vibration plates 6, and the lead-out electrode 32*a* exhibit strong bonding forces to the elastic plate 5 and the piezoelectric vibration plates 6. Conductive material, such as platinum or platinum alloy, is applied to those electrodes by vapor deposition or sputtering.

The piezoelectric vibration plates 6 (hatched areas in FIG. 4) are formed on the elastic plate such that both ends of the piezoelectric vibration plates 6 lap over the end of the corresponding first and second drive electrodes 30 and 31. More specifically, each piezoelectric vibration plate 6 is wide enough to cover both sides of each of the first and second drive electrodes 30 and 31, and long enough to connect the outside of the first pressure generating chamber group and the outside of the second pressure generating chamber group.

Reference numeral 33 designates a common electrode 33. The common electrode 33 extends over an area, which is defined between both ends 6*d* and 6*e* of the piezoelectric vibration plates 6, and contains the area for the lead-out electrode 32. The common electrode 33 is formed by applying conductive material to the area thereof by vapor deposition process or thick film formation process.

In the present embodiment thus constructed, when a voltage is applied to the common electrode 33 and one of the first drive electrodes 30, only the first half part 6*a* of the piezoelectric vibration plate 6 where those electrodes overlap is widthwise bent with respect to the longitudinal direction to deform the elastic plate 5 toward the pressure generating chamber. The piezoelectric vibration plates 6 are each electrically divided into two segments with respect to the series of the nozzle openings 21 and 22. Accordingly, only one of the half parts of the piezoelectric vibration plate 6 is bent.

The piezoelectric vibration plates 6 extend to the full width of the lead-out electrode 32*a*, and their operating regions are fixed to the elastic plate 5, with the first and second drive electrodes 30 and 31 being inserted therebetween. With this structure, a sufficient strain displacement of the piezoelectric vibration plate 6 is transmitted to the elastic plate 5.

Upon receipt of the strain displacement, the volume of the pressure generating chamber 50 is reduced to apply a pressure to the ink contained therein. Ink flows from the first pressure generating chamber group 50 through the through-hole 16 of the ink-supply-path plate 15 to the nozzle opening 21 of the nozzle plate 20. Finally, it is forcibly discharged from the nozzle opening.

When the application of the drive signal stops and the first half part 6*a* of the piezoelectric vibration plate 6 is restored to its original state, the volume of the pressure generating chamber 50 is expanded and a negative pressure is caused in the pressure generating chamber 50. Then, ink is supplied from the reservoir to the pressure generating chamber 50, through the through-hole 12 of the cover plate 7. The amount of the supplied ink corresponds to that of the discharged ink.

The piezoelectric vibration plates 6 covers the pressure generating chamber groups 50 and 51 and have no cuts on the nozzle opening sides thereof, and the surfaces and the sides thereof are covered with the common electrode 33. Therefore, the piezoelectric vibration plates are protected from moisture in the air and keep their properties even when used for a long time, without being deteriorated.

The central parts 6*c* of the piezoelectric vibration plates 6 are fastened to the elastic plate 5 also in the vicinity of the nozzle openings. Although this structure does not directly contribute to the ink discharging operation, these parts are reenforced, so that the factors to deteriorate the print quality, such as cross talk, are reduced.

Figure 5A:
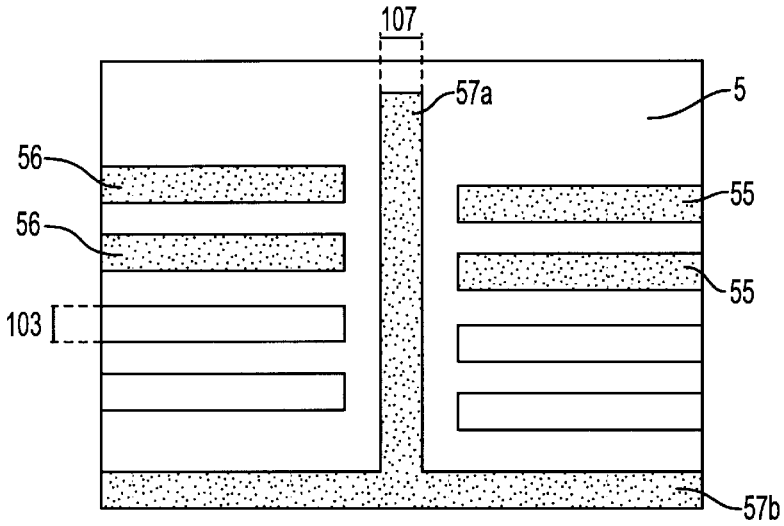
FIGS. 5(*a*) to (*c*) are diagrams showing steps of manufacturing the drive unit.

A method of manufacturing the thus constructed ink jet recording head will be described with reference to FIG. 5.

A clay-like, thin plate, so called a green sheet, made of ceramics, such as zirconia, is used, which has the thickness suitable for formation of the pressure generating chambers 50 and 51. The green sheet is punched by a press to form through-holes 3 and 4 at the locations where the pressure generating chambers are to be formed. This sheet will be referred to as a first sheet. Similarly, another green sheet made of zirconia, which has the thickness suitable for formation of the elastic plate 5, is prepared.

The first and second sheets are layered one on the other, and bonded together by uniformly applying pressure to the layered sheets, and then dried. By the drying process, the two sheets are provisionally bonded together and made 15 semisolid. Then, the resultant structure is sintered at 1000° C., for example, while being placed under such a pressure as not to cause a warpage thereof. As a result, the material of those sheets is transformed into ceramics, and by the sintering process, the two sheets are integrated into a structure like a single structure.

Patterns 55 and 56 are formed on the surface of the portion of the thus formed structure, which will serve as the elastic plate 5. These patterns are extended from the inner ends of the pressure generating chambers 50 and 51 to both sides of the elastic plate 5. The patterns are made of conductive material which exhibits a high bonding force when the elastic plate 5 and a green sheet made of piezoelectric material to be described later are sintered. This material may be platinum, platinum alloy, silver or silver alloy. To form the patterns, a conductive pattern forming technique, such as sputtering or screen print, may be used.

During the formation of the patterns 56 for the drive electrodes, a pattern 57*a* led from the common electrode and another pattern 57*b* are formed. The pattern 57*a* is located between these pattern groups. The pattern 57*a* is made of conductive material which exhibits a high bonding force when the elastic plate 5 and a green sheet made of piezoelectric material to be described later are sintered. This material may be platinum, platinum alloy, silver or silver alloy. To form the patterns, a conductive pattern forming technique, such as sputtering or screen print, may be used (FIG. 5*a*).

Figure 5B:
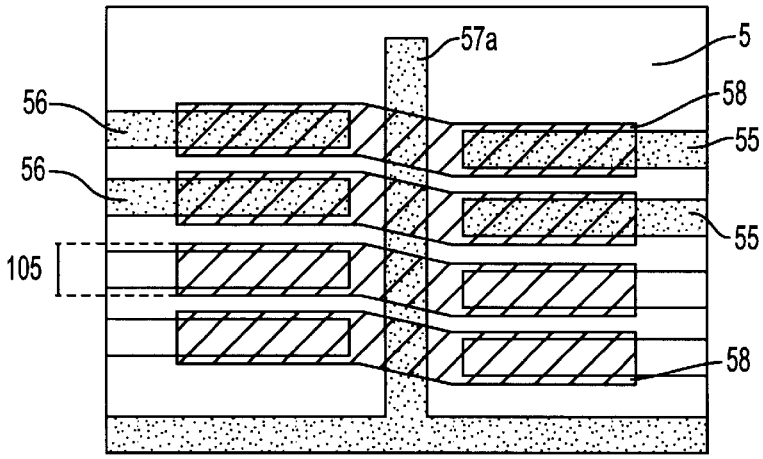
Figure 5C:
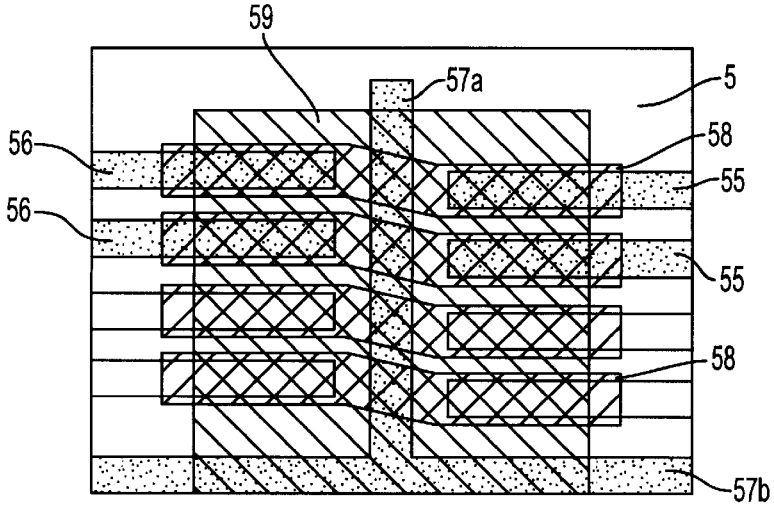

After the electrode patterns 55, 56, 57*a*, and 57*b* are formed, patterns 58 made of piezoelectric material are formed by a thick film printing method, while using a template, for example (FIG. 5*b*). The patterns 58 are thicker than the patterns 55 and 56 of the drive electrodes. Each pattern 58 extends from a location near to the outer end of each drive electrode pattern 55 to the outer end of the drive electrode pattern 56 located in association with that pattern 55. The piezoelectric material is preferably PZT.

Also in the thick film printing of the piezoelectric material, two piezoelectric vibration plates for driving the opposed pressure generating chambers are printed through one continuous window. Accordingly, the formed piezoelectric vibration plates little suffer from disconnection, and the piezoelectric material may be more uniformly pressed against the electrode patterns than in the conventional method in which windows are provided for the pressure generating chambers, respectively.

Figure 10:
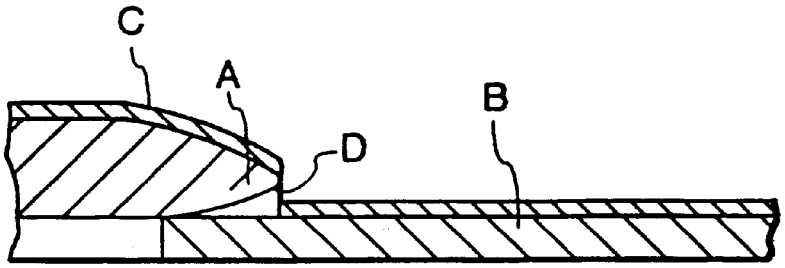
FIG. 10 is a cross sectional view showing in enlarged manner the structure in the vicinity of the lead-out electrode for the piezoelectric vibration plates in a conventional ink jet recording head.

When the piezoelectric material is dried to a preset dryness, it is sintered at temperature suitable for the sintering the piezoelectric material, for example 1000° C. to 1200° C. Also during the sintering process, the piezoelectric material is still continuous, and pressed against the pattern 57*a* of the high bonding material, which is for the lead-out electrode led from the common electrode. Therefore, the tip of the piezoelectric vibration plate is not raised from the lead-out electrode (FIG. 10).

When the sintering process of the piezoelectric material ends, a conductive pattern 59, which covers the areas of both ends of the piezoelectric vibration plates and the lead-out electrode layer, is formed by successively forming layers of conductive material, copper and nickel by a film forming process, such as vapor deposition process, thereby forming the second electrodes for the piezoelectric vibration plates. The drive electrode patterns 55 and 56 are covered with the patterns 55 and 56 for the piezoelectric vibration plates in the area except the areas of the ends, which are to be the external connection parts. Therefore, these are not electrically connected to the common electrode 59.

Figure 6A:
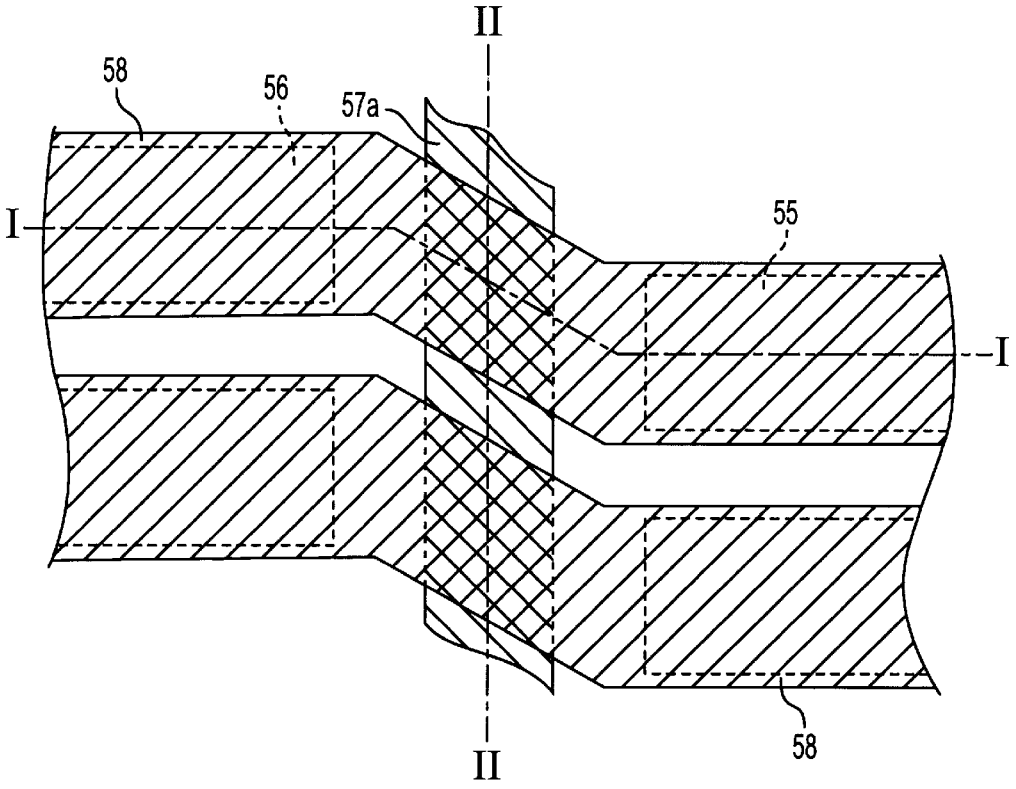
FIG. 6(*a*) is enlarged top view showing the relationship among the lead-out electrode located in the central part, the piezoelectric vibration plates, and the drive electrodes.
Figure 6B:
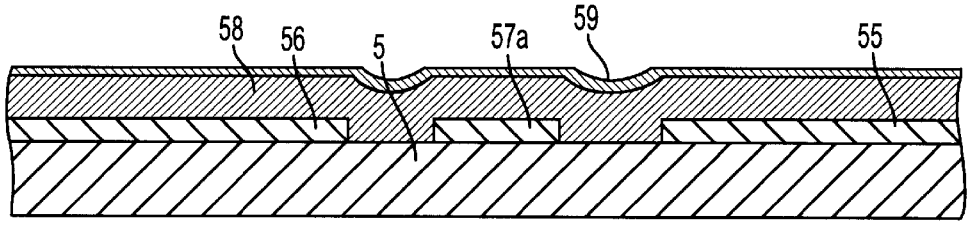
Figure 6C:
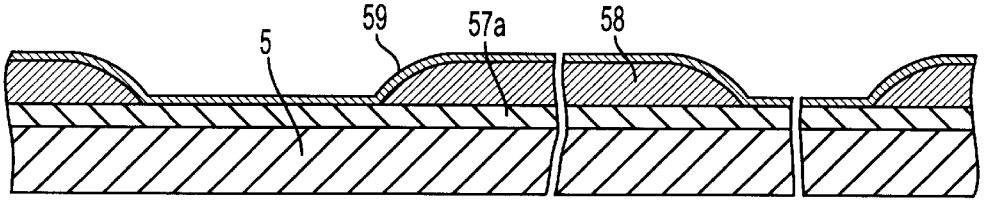

As shown in FIGS. 6*a* to 6*c*, the piezoelectric vibration plate 58, which is formed continuous to the two conductive patterns 55 and 56 for the drive electrodes, is stepped at the central part across the pattern 57*a* for the lead-out electrode led from the common electrode. The piezoelectric vibration plate is fastened to the elastic plate 5 by a large bonding force, with the lead-out electrode pattern 57*a* intervening therebetween.

Figure 7:
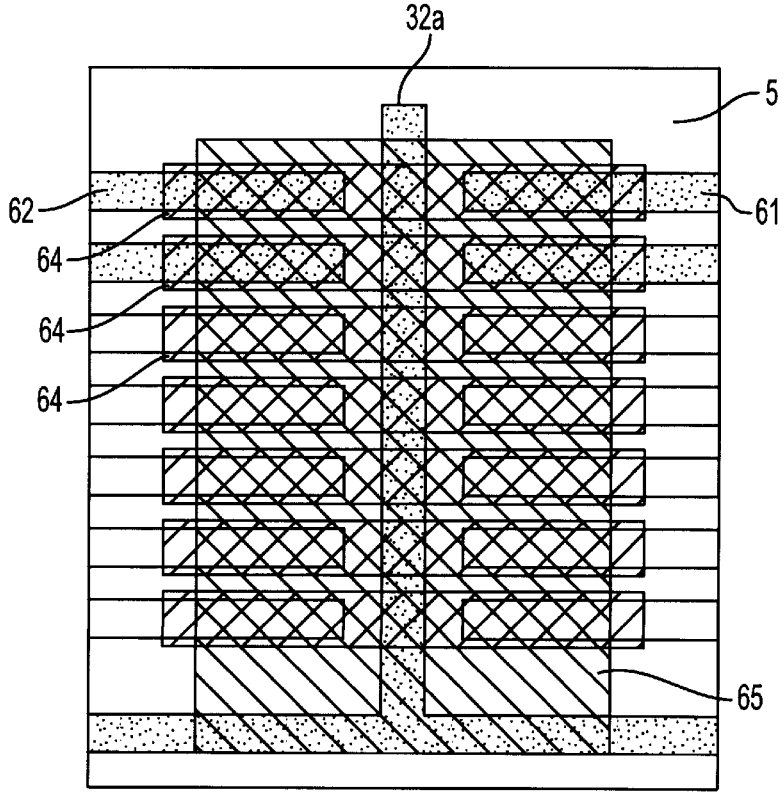
FIG. 7 is a top view showing another embodiment of the present invention.

In the above-mentioned embodiment, the groups of nozzle openings are arrayed in a zig-zag fashion while the central parts thereof are slightly bent. When the groups of the nozzle openings are arrayed in line, strip-like piezoelectric vibration plates 64, as shown in FIG. 7, are arrayed on the surface of the elastic plate 5 such that the strip-like piezoelectric vibration plates 64 connect the drive electrodes 61 and 62, which are disposed symmetrical with the center, lead-out electrode 32*a*. In this case, the strip-like piezoelectric vibration plates are stepped across the lead-out electrode 32*a*. In the figure, reference numeral 65 designates a common electrode formed on the surfaces of the piezoelectric vibration plates 64.

Figure 8A:
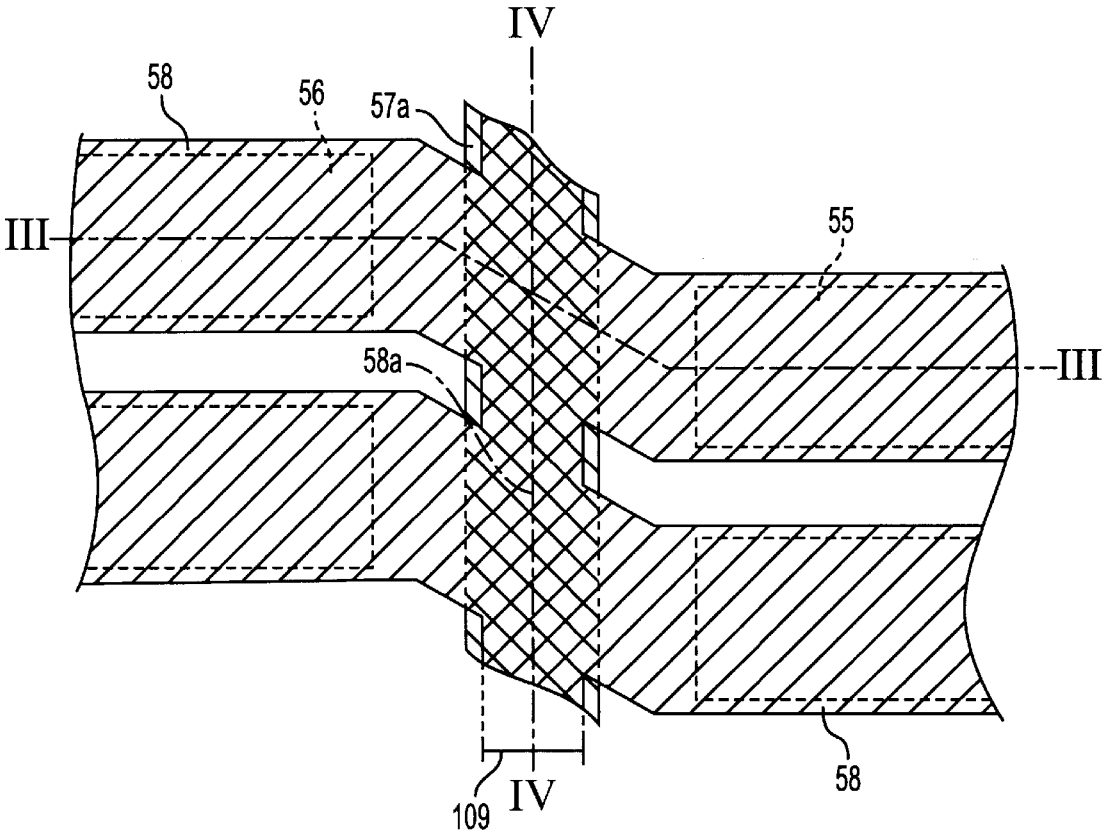
FIG. 8(*a*) is a top view showing the relationship among the lead-out electrode located in the central part, the piezoelectric vibration plates, and the drive electrodes in another embodiment of the present invention.
Figure 8B:
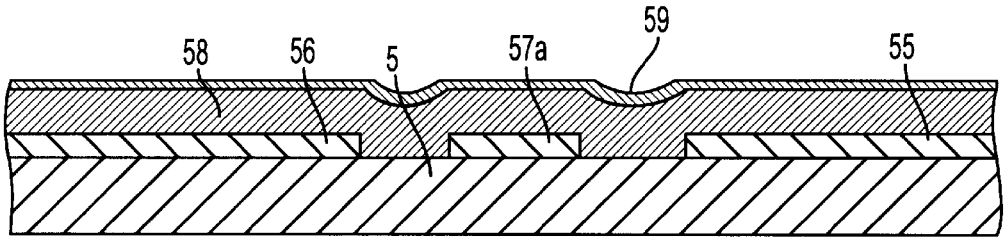
Figure 8C:
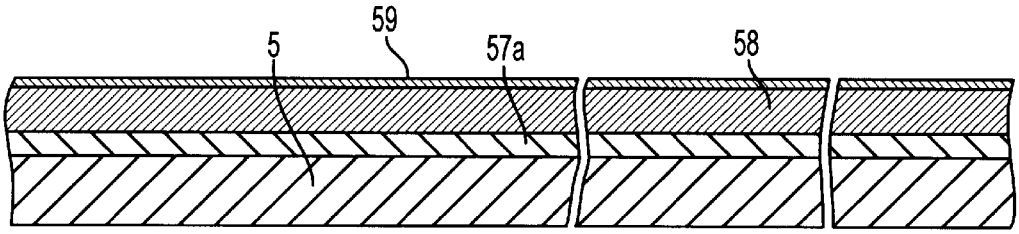

FIG. 8 shows another embodiment of the present invention. Piezoelectric vibration plates 58 are formed so as to be continuous to conductive patterns 55 and 56 for two drive electrodes. An area 58*a*, which connects the adjacent piezoelectric vibration plates vertically shifted on the surface of the center, lead-out electrode 57*a*, is contained in the piezoelectric vibration plate 58.

In this embodiment, no stepped portions are present on the lead-out electrode 57*a*. Therefore, the common electrode 59 covering the piezoelectric vibration plates 58 are flush with the lead-out electrode 57*a*. Therefore, conductivity of the whole common electrode 59 can be secured.

Figure 11A:
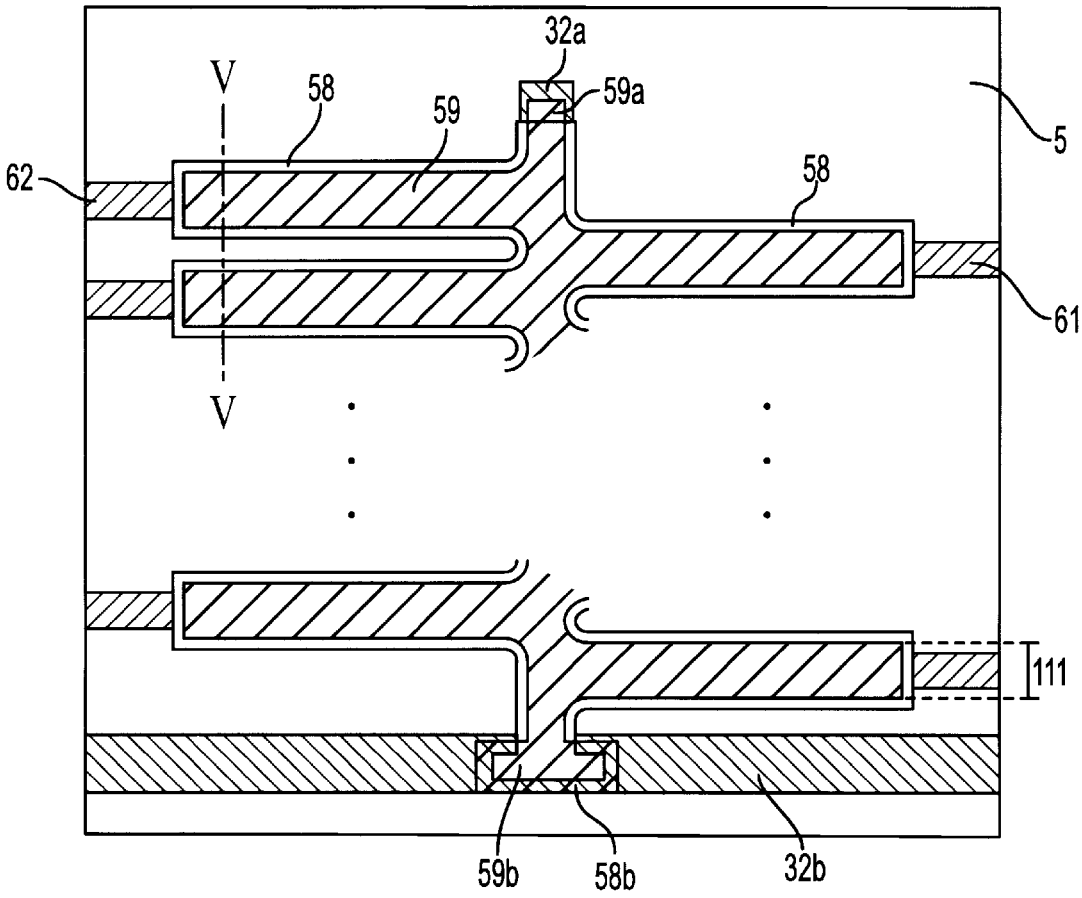
FIGS. 11(*a*) and 11(*b*) are a top view showing an additional embodiment of the present invention, and a cross sectional view taken on line V—V.
Figure 11B:
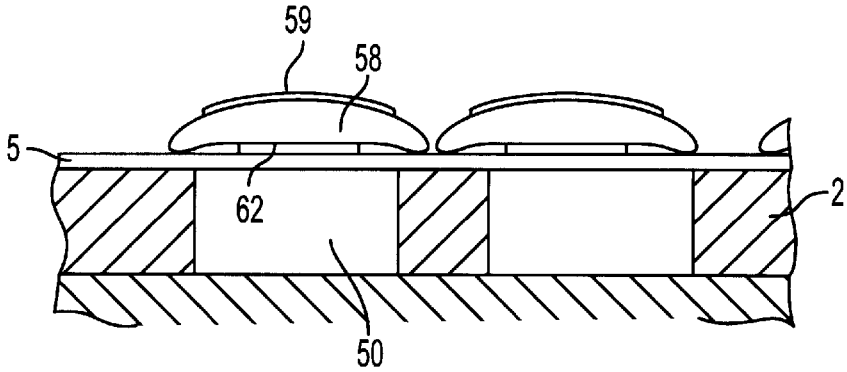

FIGS. 11*a* and 11*b* show another embodiment of the present invention. As shown, piezoelectric vibration plates 58 interconnect with one another on the surface of the lead-out electrode 32*a* led from the common electrode, as in the embodiment of FIG. 8. A common electrode 59, shaped like a double-teeth comb, is formed on the piezoelectric vibration plates 58. The width of the common electrode 59 is shorter than the width of the piezoelectric vibration plate 58.

In this structure, the piezoelectric vibration plates 58 lie between the drive electrodes 62 and the common electrode 59, thereby improving the electrical insulation between the electrodes (FIG. 11*b*). Further, the structure is durable under the condition of high temperature and long time use. in this embodiment, in the connection area to the lead-out electrode 32*b*, the piezoelectric vibration plate 58*b* is extended in width and covers the piezoelectric vibration plate 59*b*. By so shaping those electrodes, a contact area of the common electrode 59*b* and the lead-out electrode 32*b* is increased (cross hatched area).

As the result of the increased contact area, large current can be fed from the lead-out electrode 32*b* to the common electrode 59*b*. Therefore, the structure is durable even when it is used in a heavy-duty mode of high frequency drive, multi-nozzle drive, or the like.

While two groups of the piezoelectric vibration plates are symmetrically arrayed with respect to a line in the above-mentioned embodiment, it is evident that the present invention is applicable to one group of the piezoelectric vibration plate.

Figure 9:
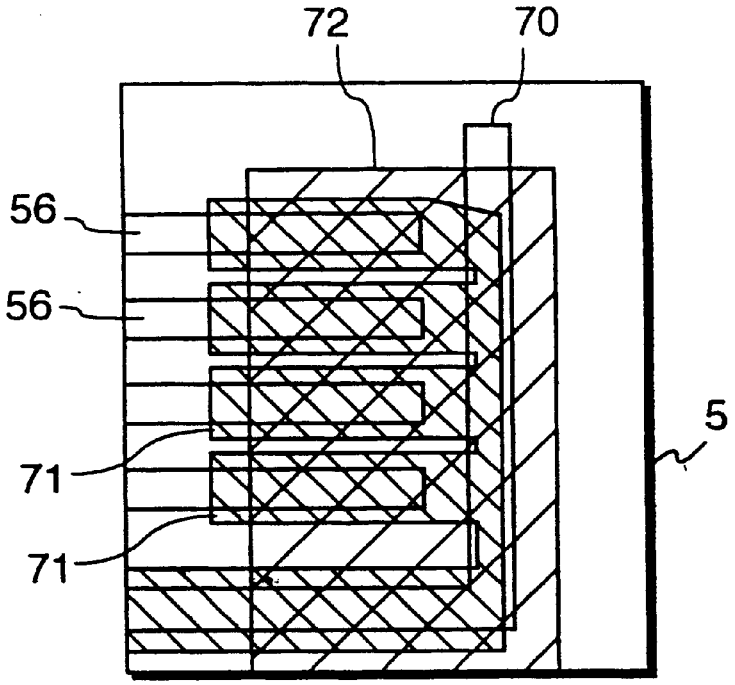
FIG. 9 is a top view showing a further embodiment of the present invention.

As shown in FIG. 9, a lead-out electrode 70 led from the common electrode is disposed in opposition to the external connection terminals of the drive electrode 56. Piezoelectric vibration plates 71, shaped like a comb, are formed on the lead-out electrode 70. The common electrode 72 is free from its disconnection because at least the surface of the lead-out electrode 70 is flat.

In the above-mentioned embodiments, in a state that the elastic member and the spacer member are bonded into a unit member, the piezoelectric vibration plate is formed. If required, for the single elastic member, the piezoelectric vibration plate may be formed.

What is claimed is:

1. A method of manufacturing an ink jet recording head, said head having an elastic plate, said method comprising the steps of:

forming first and second groups of drive electrodes, and a common lead-out electrode, directly on said elastic plate, wherein said first and second groups are on opposite sides of said common lead-out electrode, using a material selected from a group consisting of platinum, platinum alloy, silver, and silver alloy;

forming patterns made of piezoelectric material, the patterns each being wider than one of the drive electrodes, and the patterns each extending from one end of one drive electrode of said first group of drive electrodes to an end of a drive electrode of said second group of drive electrodes; and sintering the piezoelectric material.

2. The manufacturing method according to claim 1, further comprising fastening a spacer member to the elastic plate before said step of forming said drive electrodes.

3. The manufacturing method according to claim 1, wherein the elastic plate is ceramic.

4. A method of manufacturing an ink jet recording head, the head having an elastic plate, the method comprising the steps of:

forming drive electrodes and a common lead-out electrode directly on the elastic plate, the common lead-out electrode being spaced from the drive electrodes, using a material selected from a group consisting of platinum, platinum alloy, silver, and silver alloy;

forming patterns made of piezoelectric material, each overlapping a portion of the common lead-out electrode and an end of one of the drive electrodes; and forming a common electrode on the patterns of piezoelectric material and electrically connected to the common lead-out electrode.

5. The method of manufacturing an ink jet recording head as set forth in claim 4, wherein each of the patterns of piezoelectric material is formed so as to connect to an adjacent one of the patterns of piezoelectric material at the common lead-out electrode.

6. A method of manufacturing an ink jet recording head, the head having an elastic plate, the method comprising the steps of:

forming drive electrodes and a common lead-out electrode directly on the elastic plate, the common lead-out electrode being spaced from the drive electrodes, using a material selected from a group consisting of platinum, platinum alloy, silver, and silver alloy;

forming patterns made of piezoelectric material, each overlapping a portion of the common lead-out electrode and extending continuously so as to overlap an end of one of the drive electrodes; and forming a common electrode overlapping the patterns of piezoelectric material and electrically connected to the common lead-out electrode.

7. The ink jet recording head according to claim 6, wherein the patterns of piezoelectric material are all connected together over the lead-out electrode.

* * * * *